US009328549B1

(12) United States Patent
Alexander et al.

(10) Patent No.: US 9,328,549 B1
(45) Date of Patent: May 3, 2016

(54) FRAME WITH THERMAL BARRIER

(71) Applicants: Markam R. Alexander, Dowagiac, MI (US); Andrew J. Seiser, Schoolcraft, MI (US)

(72) Inventors: Markam R. Alexander, Dowagiac, MI (US); Andrew J. Seiser, Schoolcraft, MI (US)

(73) Assignee: SPECIAL-LITE, INC., Decatur, MI (US)

( * ) Notice: Subject to any disclaimer, the term of this patent is extended or adjusted under 35 U.S.C. 154(b) by 0 days.

(21) Appl. No.: 14/677,105

(22) Filed: Apr. 2, 2015

(51) Int. Cl.
*E06B 1/32* (2006.01)
*E06B 1/18* (2006.01)
*E06B 1/16* (2006.01)

(52) U.S. Cl.
CPC . *E06B 1/325* (2013.01); *E06B 1/16* (2013.01); *E06B 1/18* (2013.01)

(58) Field of Classification Search
CPC ..... E06B 1/04; E06B 1/12; E06B 1/28; E06B 3/263; E06B 3/964; E04B 2/00
USPC ..... 52/204.1, 656.2
See application file for complete search history.

(56) References Cited

U.S. PATENT DOCUMENTS

| | | | | |
|---|---|---|---|---|
| 3,093,217 | A | 6/1963 | Doede | |
| 4,055,923 | A | 11/1977 | Biebuyck | |
| 4,219,983 | A | 9/1980 | Kern et al. | |
| 4,231,207 | A | 11/1980 | Kern et al. | |
| 4,257,202 | A * | 3/1981 | Biro | 52/204.51 |
| 4,598,513 | A | 7/1986 | Gartner | |
| 4,815,245 | A | 3/1989 | Gartner | |
| 4,896,613 | A | 1/1990 | Salzer | |
| 5,117,601 | A * | 6/1992 | Habicht | E06B 3/273 52/204.593 |
| 5,579,616 | A * | 12/1996 | Farag | E06B 3/5427 52/204.5 |
| 5,937,597 | A | 8/1999 | Sono et al. | |
| 6,035,596 | A * | 3/2000 | Brunnhofer | E06B 3/26303 49/DIG. 1 |
| 6,035,600 | A | 3/2000 | Habicht et al. | |
| 6,202,353 | B1 * | 3/2001 | Giacomelli | E06B 3/2632 49/504 |
| 6,857,233 | B2 * | 2/2005 | Farag | 52/235 |
| 7,096,640 | B1 * | 8/2006 | Chevian et al. | 52/204.591 |
| 7,913,470 | B2 * | 3/2011 | Siodla | E06B 3/26301 403/331 |
| 8,024,898 | B2 * | 9/2011 | Alvarado | 52/211 |
| 8,176,709 | B2 | 5/2012 | Siodla | |
| 8,266,850 | B2 * | 9/2012 | Neal | 52/204.1 |
| 8,322,090 | B2 * | 12/2012 | Moriya et al. | 52/204.591 |
| 8,828,171 | B2 | 9/2014 | Wust et al. | |
| 2006/0018095 | A1 * | 1/2006 | Rawlings | 361/701 |
| 2008/0178552 | A1 * | 7/2008 | Dampierre | 52/656.2 |
| 2009/0229202 | A1 * | 9/2009 | Dampierre | 52/213 |
| 2011/0197515 | A1 | 8/2011 | Joray | |

OTHER PUBLICATIONS

AAMA TIR A8-08 Structural Performance of Composite Thermal Barrier Framing Systems; American Architectural Manufacturers Association; 2008 (35 pages).
How it works; Azon International Webpage printed Jun. 10, 2013 (2 pages).
System 8750XD 3" × 7 1/2" Unitized Curtain Wall with Duracast® Fiberglass Composite; EFCO Corporation Brochure; 2012 (2 pages).
Exactly.; EFCO Corporation Advertisement; 2013 (1 page).
XTherm System 8750XD; EFCO Corporation Webpage; printed May 9, 2013 (1 page).

* cited by examiner

*Primary Examiner* — Brian Glessner
*Assistant Examiner* — Paola Agudelo
(74) *Attorney, Agent, or Firm* — Flynn, Thiel, Boutell & Tanis, P.C.

(57) ABSTRACT

A frame for a window or a door, or both, is provided. The frame includes at least two metal frame members which are separated. A thermal strut engages both frame members, creating a thermal barrier between the frame members and acting as a structural component of the frame.

17 Claims, 3 Drawing Sheets

FRAME WITH THERMAL BARRIER

BACKGROUND OF THE INVENTION

This invention generally relates to a window or door frame, and more particularly to a window or door frame with a heat-insulated structural section.

The use of metal, specifically aluminum, for metal frames of windows and doors allows a great transfer of heat between frame elements.

To solve this problem, thermal barriers have been used to create an insulation between frame members. However, such thermal insulation members in commercially available window and door frames do not provide structural support to the frame system, but instead are merely an additional component to the system, which adds cost and construction time. The overall structures of the prior art frame systems require the pressure of glass panels or other substantial structure to hold the structure together.

The metal frame of the present invention addresses this issue. One embodiment of the present invention is a frame to be used with a window or door in a building structure, where the frame has a first frame member comprised of metal. The first frame member has a first longitudinal axis, a first longitudinal extension, and a second longitudinal extension adjacent the first longitudinal extension. The first longitudinal extension and the second longitudinal extension together define a first channel. The frame also includes a second frame member comprised of metal. The second frame member has a second longitudinal axis, a third longitudinal extension, and a fourth longitudinal extension adjacent the third longitudinal extension. The third and fourth longitudinal extensions together define a second channel. A strut being a pultrusion comprised of fiberglass has a central base, a first side member extending from the central base, and a second side member extending from the central base. The first frame member is not in direct contact with the second frame member and the first side member of the strut resides at least partially within the first channel. The second side member of the strut resides at least partially within the second channel. The strut creates a thermal barrier between the first frame member and the second frame member and acts as a structural reinforcement of the frame.

Another embodiment of the invention is a frame to be used with a window or door of a building structure, where the frame comprises a first hollow frame member comprised of metal. The first hollow frame member has a first longitudinal axis and a first frame member wall, with a first longitudinal member attached to the first frame member wall and extending in a direction substantially parallel to the first longitudinal axis. A second longitudinal member is attached to the first frame member wall and extends in a direction substantially parallel to the first longitudinal axis and is located adjacent the first longitudinal member. The first longitudinal member and the second longitudinal member together define a first channel. The frame also comprises a second hollow frame member comprised of metal and which has a second longitudinal axis and a second frame member wall. A third longitudinal member is attached to the second frame member wall and extends in a direction substantially parallel to the second longitudinal axis. A fourth longitudinal member is attached to the second frame member wall and extends in a direction substantially parallel to the second longitudinal axis and is located adjacent the third longitudinal member. The third longitudinal member and the fourth longitudinal member together define a second channel. A fiberglass pultruded strut is provided and comprises a central base, a first side member extending from the central base, and a second side member extending from the central base. The first frame member is not in direct contact with the second frame member. The first side member of the strut resides at least partially within the first channel and is fixedly secured within the first channel at least in part by use of an adhesive. The second side member of the strut resides at least partially within the second channel and is fixedly secured within the second channel at least in part by use of an adhesive. The strut creates a thermal barrier between the first frame member and the second frame member and acts as a structural reinforcement of the frame.

Other advantages, objects and/or purposes of the invention will be apparent to persons familiar with constructions of this general type upon reading the following specification and inspecting the accompanying drawings.

BRIEF DESCRIPTION OF THE DRAWING FIGURES

DETAILED DESCRIPTION OF THE PREFERRED EMBODIMENT

Figure 1:
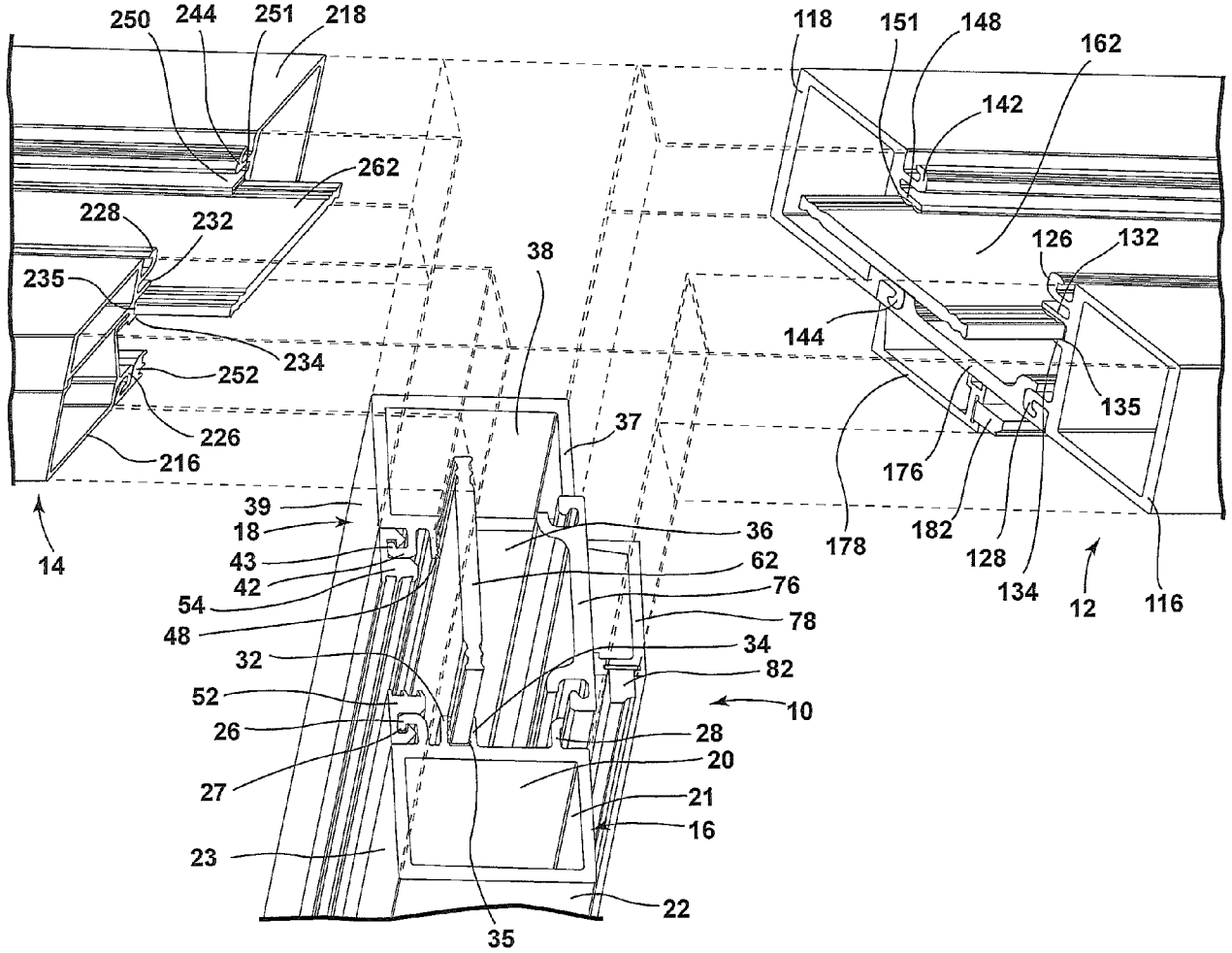
FIG. 1 is a cut-away top perspective view of a door and window frame system that embodies the present invention.

Certain terminology will be used in this description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the particular arrangement and designated parts thereof. This terminology will include the words specifically mentioned, derivatives thereof, and words of similar import.

As shown in FIG. 1, a frame system may include a vertical jamb 10, a horizontal head door jamb 12, and a horizontal head window jamb 14. Each of the jambs 10, 12, 14 includes a thermal strut to insulate one frame member from another, as discussed in more detail below.

Figure 2:
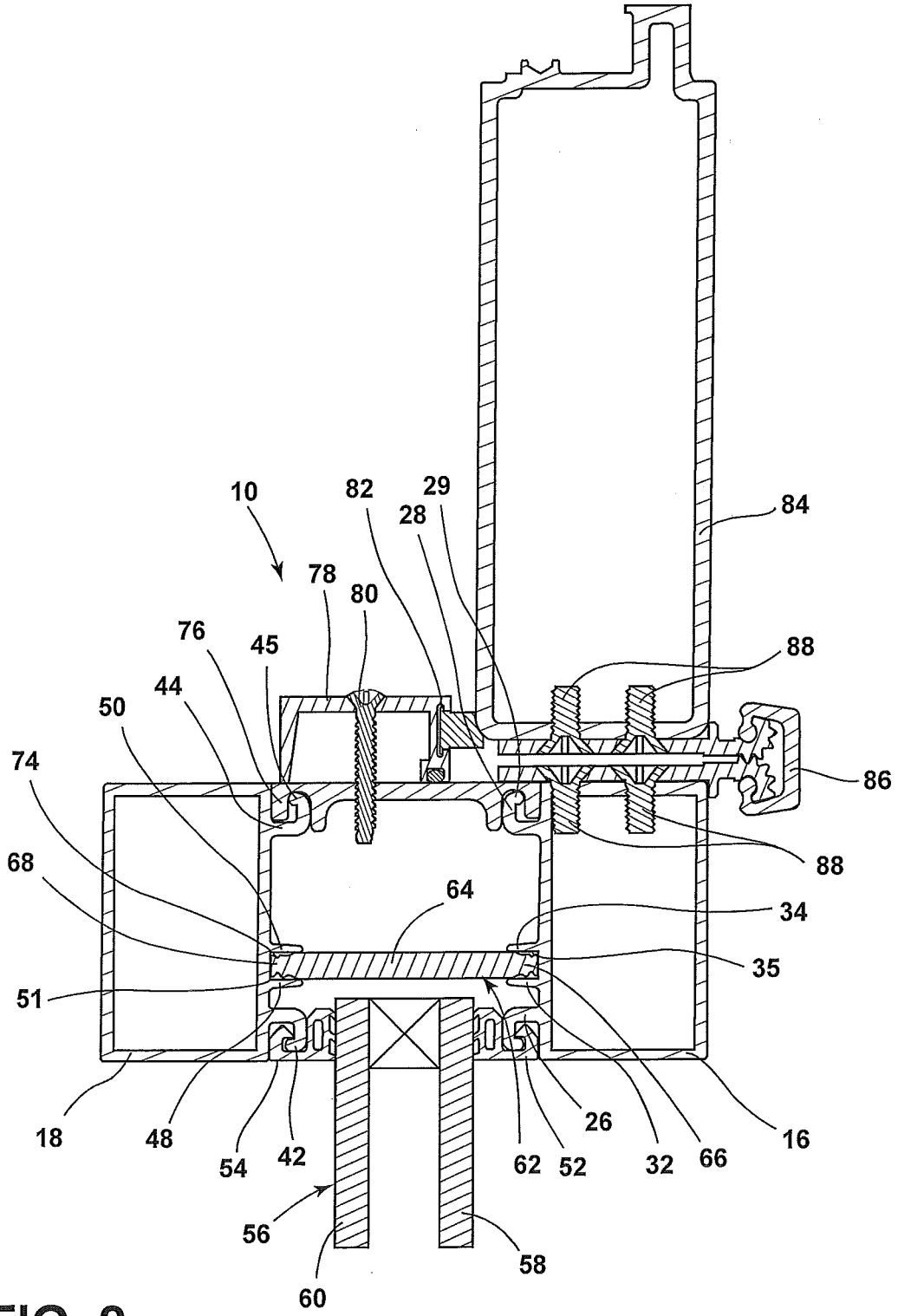
FIG. 2 is a top plan cross-sectional view of the frame system of FIG. 1.

The vertical jamb 10, as shown in FIGS. 1-2, includes a first frame member 16 and a second frame member 18 which is spaced from and which extends longitudinally in a substantially parallel fashion with respect to the first frame member 16. The first and second frame members 16, 18 are preferably of a metal such as aluminum, and are depicted in FIGS. 1 and 2 as being rectangular in shape, but it is contemplated that they may take other shapes as well. The first frame member 16 has four side walls 20, 21, 22, 23 which extend the entire length of the frame, and which together create a hollow member.

Extending from the wall 20 are a first hook member 26 and a second hook member 28. The hook members 26, 28 are spaced from one another and preferably extend the entire length of the first frame member 16. The hook members 26, 28 each have a hook portion 27, 29 which arch away from one another.

Also extending inwardly from the wall 20 is a first holding member 32 and a second holding member 34. The two holding members 32, 34 are adjacent the first hook member 26 and adjacent one another but spaced apart creating a channel 35 between them. The first holding member 32 and the second holding member 34 may be parallel to each other in the inward direction, but are preferably not parallel and are angled toward one another as they extend inwardly. Each of the holding members 32, 34 preferably extends the entire length of the first frame member 16.

As shown in FIGS. 1 and 2, the second frame member 18 is a mirror image of the first frame member 16, although it is contemplated that either of the frame members 16, 18 may be of any workable shape, and the second frame member may take different shapes and forms than the first frame member. As shown in FIGS. 1 and 2, the second frame member 18 has side walls 36, 37, 38, 39, as well as a first hook member 42 and a second hook member 44 extending from the side wall 36. The first hook member 42 has a hook portion 43 and the second hook member 44 has a hook portion 45. Also extending from the side wall 36 are a first holding member 48 and a second holding member 50. The holding members 48, 50 are adjacent the first hook member 42 and are spaced from one another, creating a channel 51 between them. The first holding member 48 and the second holding member 50 may be parallel to one another inwardly, but are preferably not parallel and angled toward each other as they extend inwardly. Each of the holding members 48, 50 preferably extends the entire length of the second frame member 18.

On the window side of the vertical jamb 10 are two vinyl bulbs 52, 54. The vinyl bulb 52 is engaged with the hook member 26 which holds the vinyl bulb 52 in place. The vinyl bulb 54 is engaged with the hook member 42, which holds the vinyl bulb 54 in place. The vinyl bulbs 52, 54 extend the entire length or substantially the entire length of the vertical jamb 10 and retain a window 56. The window is preferably made up of two window panes 58, 60, as shown in FIG. 2.

A thermal strut 62 is engaged with both the first frame member 16 and the second frame member 18. The thermal strut 62 preferably extends the entire length of the vertical jamb 10 creating a thermal barrier between the first frame member 16 and the second frame member 18, while providing structural support to the vertical jamb 10. To create a strut which has both insulating properties and enough strength to be a structural component of the jamb, the thermal strut 62 is preferably made of fiberglass, more preferably is a fiberglass pultrusion, and most preferably is a pultrusion comprising a mixture of fiberglass and a polyester resin. The fiberglass to polyester resin ratio is preferably about 1:1 and is more preferably greater than 1:1.

Figure 3:
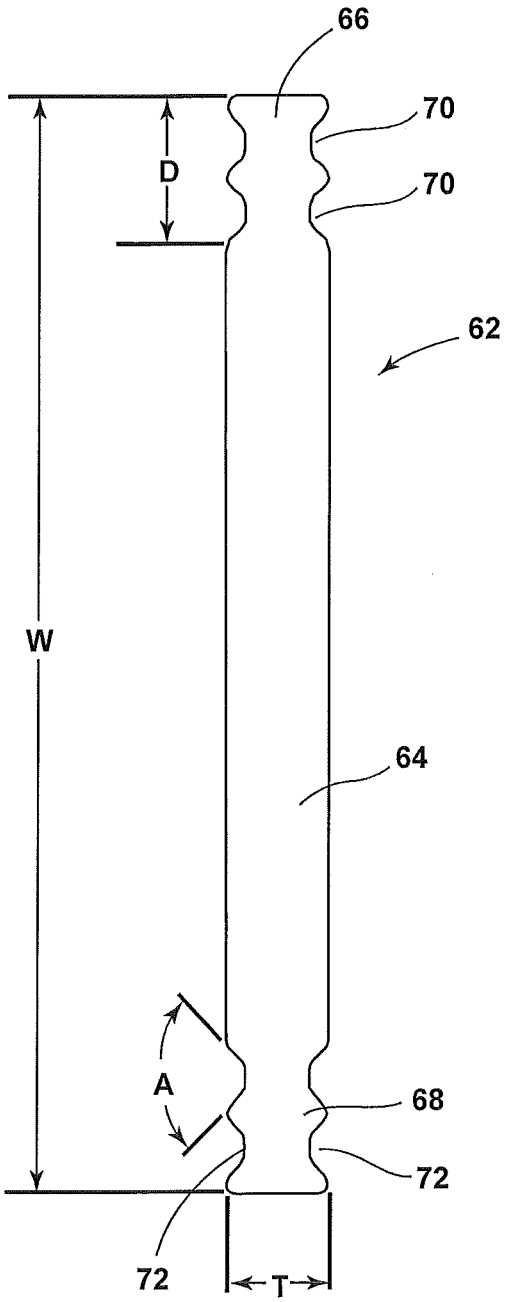
FIG. 3 is a top plan view of a thermal strut that is part of the frame system of FIG. 1.

The shape of the thermal strut 62 is shown in detail in FIG. 3. The thermal strut has a central portion or base 64, a first side portion 66 at one side of the thermal strut 62, and a second side portion 68 at the opposite side of the thermal strut 62. The first side portion 66 has two grooves 70 on both the front and the back of the thermal strut 62. Likewise, the second side portion 68 has two grooves 72 on both the front and back of the thermal strut 62. The grooves 70, 72 preferably extend the entire length of the thermal strut 62. The grooves 70, 72 essentially have the shape of a trapezoid with the two side edges at an angle A with respect to one another, as depicted in FIG. 3. Angle A is preferably between about 85° and about 95°, and more preferably is about 90°. The thermal strut has a total width W and a thickness T, and the first side portion 66 and the second side portion 68 each have a width dimension D. The ratio of the total width W to the width dimension D of each of the side portions 66, 68 is preferably about 7.5 to 1. The ratio of the width dimension W to the thickness T is preferably about 10.5 to 1.

As shown in FIGS. 1 and 2, the first side portion 66 of the thermal strut 62 is received within the channel 35 and the second side portion 68 is received by the channel 51. Preferably, the thermal strut 62 is not crimped within the channels 35, 51, but instead is either retained by a friction fit or the use of an adhesive 74, or both. A preferred adhesive is a two-part methyl methacrylate, and it is preferred that adhesive is used along the entire length of the thermal strut 62.

A thermal pocket filler 76 is also engaged with both the first frame member 16 and the second frame member 18. The thermal pocket filler 76 is preferably also a fiberglass pultrusion, and more preferably a pultrusion of a fiberglass and polyester resin. The thermal pocket filler 76 is engaged with both second hook members 28, 44 which together retain the thermal pocket filler 76 in the vertical jamb 10. The thermal pocket filler 76 is used on the door side of the jamb 10 and may have a straight or hook-like member to engage with the hook portions 29 and 45.

A door stop 78 is attached to the thermal pocket filler 76, preferably by one or more fasteners 80. The door stop 78 retains a perimeter gasket 82 for engaging a door 84 which is attached to the first frame member 16 via a hinge 86 and fasteners 88.

As shown in FIG. 1, the horizontal head door jamb 12 has similar parts to the door-side portion of the vertical jamb 10. Thus, similar parts in the head door jamb 12 will be given like part numbers, plus 100, with respect to the vertical jamb 10 part numbers.

The head door jamb 12, as shown in FIG. 1, includes a first frame member 116 and a second frame member 118 which is spaced from and which extends longitudinally in a substantially parallel fashion with respect to the first frame member 116. The first and second frame members 116, 118 are preferably of a metal such as aluminum, are hollow, and are depicted in FIG. 1 as being rectangular in shape, but it is contemplated that they may take other shapes as well.

A first hook member 126 and a second hook member 128 arch from the first frame member 116. The hook members 126, 128 are spaced from one another and preferably extend the entire length of the first frame member 116.

Extending inwardly from the first frame member 116 are a first holding member 132 and a second holding member 134. The two holding members 132, 134 are adjacent the first hook member 126 and one another but are spaced apart from one another, creating a channel 135 between them. Each of the holding members 132, 134 preferably extends the entire length of the first frame member 116. The first holding member 132 and the second holding member 134 may be parallel to one another in the inward direction, but are preferably not parallel and are angled toward each other as they extend inwardly.

As shown, the second frame member 118 is a mirror image of the first frame member 116, although it is contemplated that either of the frame members 116, 118 may be of any workable shape, and the second frame member 118 may take different shapes and forms than the first frame member 116. As shown in FIG. 1, the second frame member 118 has a first hook member 142 and a second hook member 144, which arch away from each other.

Extending inwardly from the second frame member 118 are a first holding member 148 and a second holding member (not shown). The holding members are adjacent the first hook member 142 and are spaced from one another, creating a channel 151 between them. The first holding member 148 and the second holding member may be parallel to one another, but are preferably not parallel in the inward direction and are angled toward each other as they extend inwardly.

A thermal strut 162 is engaged with both the first frame member 116 and the second frame member 118. The thermal strut 162 preferably extends the entire length of the door head jamb 12 creating a thermal barrier between the first frame member 116 and the second frame member 118, while providing structural support to the door head jamb 12. The thermal strut 162 is preferably of the same substance and of the same shape as that of the thermal strut 62.

As shown in FIG. 1, the thermal strut 162 is received partially within the channel 135 and within the channel 151. Preferably, the thermal strut 162 is not crimped within the channels 135, 151, but instead is either retained by a friction fit or the use of an adhesive, or both. It is preferred that adhesive is used along the entire length of the thermal strut 162.

A thermal pocket filler 176 is also engaged with both the first frame member 116 and the second frame member 118. The thermal pocket filler 176 is preferably also a fiberglass pultrusion, more preferably a pultrusion of a fiberglass and polyester resin. The thermal pocket filler 176 is engaged with both hook members 128, 144 which together retain the thermal pocket filler 176 in the door head jamb 12.

A door stop 178 is attached to the thermal pocket filler 176, preferably by one or more fasteners. The door stop 178 retains a perimeter gasket 182 for engaging a door.

As shown in FIG. 1, the horizontal head window jamb 14 has similar parts to the window-side portion of the vertical jamb 10. Thus, similar parts in the head window jamb 14 will be given like part numbers, plus 200, with respect to the vertical jamb 10 part numbers.

The head window jamb 14, as shown in FIG. 1, includes a first frame member 216 and a second frame member 218 which is spaced from and which extends longitudinally in a substantially parallel fashion with respect to the first frame member 216. The first and second frame members 216, 218 are preferably of a metal such as aluminum, are hollow, and may take other shapes than those shown in FIG. 1.

Arching from the first frame member 216 are a first hook member 226 and a second hook member 228. The hook members 226, 228 are spaced from one another and preferably extend the entire length of the first frame member 216.

Also extending inwardly from the first frame member 216 are a first holding member 232 and a second holding member 234. The two holding members 232, 234 are adjacent the second hook member 228 and one another but are spaced apart from one another, creating a channel 235 between them. The holding members 232, 234 may be parallel to one another, but are preferably not parallel in the inward direction and are angled toward each other as they extend inwardly. Each of the holding members 232, 234 preferably extends the entire length of the first frame member 216.

As shown in FIG. 1, the second frame member 218 is a different shape than the first frame member 216, although it is contemplated that they may be the same shape. Both the first frame member 216 and the second frame member 218 may be of any workable shape. The second frame member 218 has a first hook member (not shown) and a second hook member 244. Extending inwardly from the second frame member 218 is a first holding member (not shown) and a second holding member 250. The holding members are adjacent the second hook member 244 and are spaced from one another, creating a channel 251 between them. The holding members may be parallel to one another in the inward direction, but are preferably not parallel and are angled toward each other as they extend inwardly. Each of the holding members preferably extends the entire length of the second frame member 218.

The head window jamb 14 has a first vinyl bulb 252, and a second vinyl bulb (not shown). The vinyl bulb 252 is engaged with the first hook member 226 which holds the vinyl bulb 252 in place. The vinyl bulbs extend the entire length or substantially the entire length of the head window jamb 14 and retain a window.

A thermal strut 262 is engaged with both the first frame member 216 and the second frame member 218. The thermal strut 262 preferably extends the entire length of the head window jamb 14 creating a thermal barrier between the first frame member 216 and the second frame member 218, while providing structural support to the head window jamb 14. The thermal strut 262 is preferably of the same substance and preferably has the same shape as that of the thermal strut 62.

As shown in FIG. 1, the thermal strut 262 is received partially within the channel 235 and the channel 251. Preferably, the thermal strut 262 is not crimped within the channels 235, 251, but instead is either retained by a friction fit or the use of an adhesive, or both. It is preferred that adhesive is used along the entire length of the thermal strut 262.

EXAMPLE

A 2"×4½" frame system, including two frame members and a thermal strut, was constructed and tested for its moment of inertia, commonly known as the I value. The frame system tested had the overall shape of the frame system 10 shown in FIGS. 1 and 2, and had the following dimensions:

Overall width: 4.50 inches
Overall depth: 2.00 inches
Overall length: 96.0 inches
Width of thermal strut: 2.00 inches
Thickness of thermal strut: 0.187 inches
Thickness of frame member walls: 0.125 inches The frame members were of aluminum and the thermal strut was a pultruded strut made of a mixture of approximately 50% fiberglass and 50% polyester resin. A methyl methacrylate adhesive was used to bond the thermal strut to each of the frame members along 100% of the length—96"—of the thermal strut.

A 10-lb/in load was applied to the frame system. Surprisingly, the frame system exhibited an I value of 4.516 $in^4$.

Frame systems of this shape, size, and material should exhibit an I value of at least 3.0 $in^4$. A 3.0 $in^4$ I value is exhibited even with a 0.080" thickness frame member wall. A similarly shaped 2"×6" frame system should exhibit an I value of at least 5.9 $in^4$.

The structure and materials of the frame system described above results in an arrangement that does not require the pressure of large panes of glass or other substantial components to hold the system together. The combination of the two frame members and the thermal strut herein results in a strong stand-alone unit while maintaining thermal insulation between the two frame members.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A frame to be used with a window or door in a building structure, the frame comprising:

a first frame member comprised of metal and having a first longitudinal axis, a first longitudinal extension, and a second longitudinal extension adjacent the first longitudinal extension, the first longitudinal extension and the second longitudinal extension together defining a first channel;

a second frame member comprised of metal and having a second longitudinal axis, a third longitudinal extension, and a fourth longitudinal extension adjacent the third longitudinal extension, the third longitudinal extension and the fourth longitudinal extension together defining a second channel; and a strut being a pultrusion comprised of fiberglass and comprising a central base, a first side member extending from the central base, and a second side member extending from the central base;

the first frame member not in direct contact with the second frame member, the first side member of the strut residing at least partially within the first channel, and the second side member of the strut residing at least partially within the second channel, the strut creating a thermal barrier between the first frame member and the second frame member and acting as a structural reinforcement of the frame such that the frame exhibits an I value of at least 3.0 $in^4$.

2. The frame of claim 1, wherein the first side member has at least one longitudinal groove therein.

3. The frame of claim 2, wherein the second side member has at least one longitudinal groove therein.

4. The frame of claim 1, wherein the first side member of the strut is not crimped in the first channel, and the second side member of the strut is not crimped in the second channel.

5. The frame of claim 1, further comprising a thermal pocket filler which is engaged with both the first frame member and the second frame member.

6. The frame of claim 5, wherein the thermal pocket filler is comprised of fiberglass.

7. A door hingedly attached to the frame of claim 1.

8. The frame of claim 1, wherein the first longitudinal extension and the second longitudinal extension are not parallel with respect to each other.

9. The frame of claim 8, wherein the third longitudinal extension and the fourth longitudinal extension are not parallel with respect to each other.

10. A frame to be used with a window or door of a building structure, the frame comprising:

a first hollow frame member comprised of metal and having a first longitudinal axis and a first frame member wall, a first longitudinal member attached to the first frame member wall and extending in a direction substantially parallel to the first longitudinal axis, and a second longitudinal member attached to the first frame member wall and extending in a direction substantially parallel to the first longitudinal axis and located adjacent the first longitudinal member, the first longitudinal member and the second longitudinal member together defining a first channel;

a second hollow frame member comprised of metal and having a second longitudinal axis and a second frame member wall, a third longitudinal member attached to the second frame member wall and extending in a direction substantially parallel to the second longitudinal axis, and a fourth longitudinal member attached to the second frame member wall and extending in a direction substantially parallel to the second longitudinal axis and located adjacent the third longitudinal member, the third longitudinal member and the fourth longitudinal member together defining a second channel; and a strut comprising both fiberglass and a polymeric resin, the strut comprising more fiberglass than polymeric resin, the strut having a central base, a first side member extending from the central base, and a second side member extending from the central base;

the first frame member not in direct contact with the second frame member, the first side member of the strut residing at least partially within the first channel and fixedly secured within the first channel at least in part by use of an adhesive, and the second side member of the strut residing at least partially within the second channel and fixedly secured within the second channel at least in part by use of an adhesive, the strut creating a thermal barrier between the first frame member and the second frame member and acting as a structural reinforcement of the frame such that the frame exhibits an I value of at least 3.0 $in^4$.

11. The frame of claim 10, further comprising a thermal pocket filler which is engaged with both the first frame member and the second frame member.

12. The frame of claim 11, wherein the thermal pocket filler is comprised of fiberglass.

13. The frame of claim 10, wherein the first longitudinal member and the second longitudinal member extend inwardly and are not parallel with respect to each other in the inwardly extending direction.

14. The frame of claim 13, wherein the third longitudinal member and the fourth longitudinal member are not parallel with respect to each other.

15. The frame of claim 10, wherein the central base has a central base thickness, the first side member has a first side member thickness, and the second side member has a second side member thickness, the first side member thickness being greater than the central base thickness and the second side member thickness being greater than the central base thickness.

16. The frame of claim 10, wherein the first side member of the strut has a plurality of longitudinal grooves on at least one face thereof.

17. The frame of claim 16, wherein the second side member of the strut has a plurality of longitudinal grooves on at least one face thereof.

* * * * *